United States Patent [19]

Castellano et al.

[11] 4,421,009

[45] Dec. 20, 1983

[54] REPEATING FIREARM

[76] Inventors: Thomas P. Castellano, 2738 Westwood Blvd., Los Angeles, Calif. 90064; Nathan Mandel, 20283 Lorenzana Ave., Woodland Hills, Calif. 91364

[21] Appl. No.: 434,564

[22] Filed: Oct. 15, 1982

[51] Int. Cl.[3] ..... F41D 11/02

[52] U.S. Cl. ..... 89/140; 89/149

[58] Field of Search ..... 89/140, 141, 142, 149

[56] References Cited

U.S. PATENT DOCUMENTS 3,000,269 9/1961 Varona et al. ..... 89/140

4,348,940 9/1982 Bremer et al. ..... 89/140

FOREIGN PATENT DOCUMENTS 629170 12/1961 Italy ..... 89/140

*Primary Examiner*—Stephen C. Bentley

*Attorney, Agent, or Firm*—Freilich, Hornbaker, Wasserman, Rosen & Fernandez

[57] ABSTRACT

A machine gun pistol is described, which can be reliably switched between semi and full automatic modes by an operator holding the gun in a natural two-hand grip. The gun includes a bolt (20, FIG. 1) and a firing pin device (22) that each slide longitudinally, a trigger assembly with a primary sear (28) that is depressed by the trigger for semiautomatic operation, and an auto control member (34) that can be depressed to switch to full automatic operation. When the control member is depressed, it connects a secondary sear (36) with the primary sear. The bolt carries a cam (40) that depresses the secondary sear (36) every time the bolt moves forward, to thereby repeatedly depress the primary sear (28) when the two sears are connected during automatic operation. The control member (34) is operated by depressing it into the frame, to avoid errors in the heat of battle. The depressable control member (34, FIG. 2) lies on the right side of the gun, forward of the trigger (14), so that when the left hand (*L*) is used to also hold the gun, the fingers of the left hand can feel and depress the control member.

10 Claims, 7 Drawing Figures

REPEATING FIREARM

BACKGROUND OF THE INVENTION

Machine guns are typically switched between semiautomatic and full automatic modes of operation by operating a selector switch. It is often difficult for the operator to remember the proper direction of movement to switch between the full and semiautomatic modes, especially in the heat of battle, or if the gun is climbing out of control during full automatic operation. Reliability of operation is, of course, of great importance. Machine gun mechanisms often include a sear that is repeatedly hit during full automatic operation, and if that sear breaks, the gun cannot operate at all. A machine gun which could be switched between full and semiautomatic operation with a minimum possibility of error during a variety of stressful conditions, and which operated with high reliability, would be of considerable value.

SUMMARY OF THE INVENTION

In accordance with one embodiment of the present invention, a repeating firearm is provided which facilitates reliable use by the operator and which operates with high reliability. The firearm includes a bolt and a firing pin device that each slide along the length of the gun, a trigger assembly that includes a sear mechanism that can release the firing device, and an auto control for operating the sear mechanism in either full or semiautomatic modes of operation. The auto control can include a member lying outside the gun frame, and moveable to a full automatic mode by depressing the member towards the gun frame. This avoids uncertainty as to the direction in which the control must be moved. The control member can be placed on the right side of the gun slightly forward of the trigger, so when a person grasps a hand grip in his right hand while his left hand holds the gun nestled between the thumb and forefinger of the left hand, the fingers of the left hand can feel and depress the control member.

The trigger assembly can include a primary sear that is depressed to release the firing pin device, while the auto control for selecting the mode of operation can include a secondary sear. The secondary sear is depressed during forward motion of the bolt. In the semiautomatic mode the two sears are unconnected. When the control member is operated, the sears are connected together, so every time the bolt moves forward and depresses the secondary sear, the primary sear is also depressed to release the firing pin device, to thereby operate the gun in the full automatic mode.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
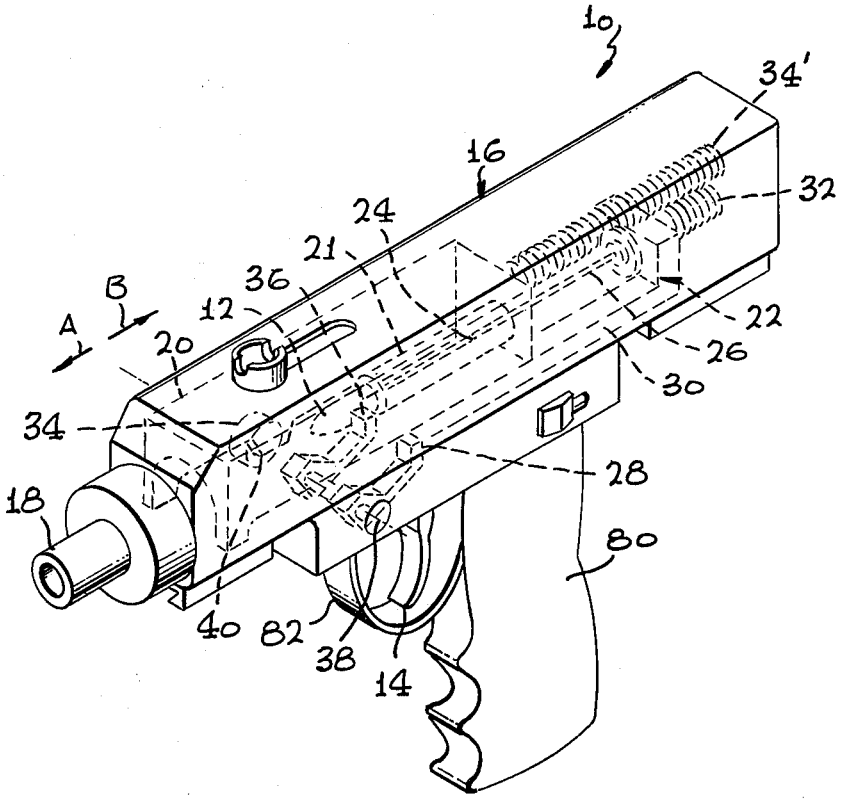
FIG. 1 is a left side perspective view of a repeating firearm constructed in accordance with one embodiment of the present invention, with some of the mechanisms shown in hidden lines.

FIG. 1 illustrates a repeating firearm or machinegun 10 which can operate in either a semiautomatic mode wherein a single cartridge 12 is fired every time a trigger 14 is pulled, or in a full automatic mode wherein cartridges are repeatedly fired so long as the trigger 14 is maintained in a pulled or rearward position. The gun includes a frame 16, and a barrel 18 mounted on the frame and having a rearward end into which the cartridge 12 is inserted. A bolt 20 can slide in the length direction of the frame, in forward and rearward direction A, B, to insert or chamber a cartridge in the gun barrel and to remove the cartridge casing. A firing pin device 22 can also slide within the frame so the tip 24 of a firing pin 26 can strike the cartridge 12 to fire it.

FIG. 1 shows the gun in a cocked position, with the bolt 20 forward with a chambering portion 21 backing up the chambered cartridge 12, but with the firing device 22 held at a rearward position by reason of a primary sear 28 lying in the path of an extension rod 30 of the firing device. When the operator pulls the trigger 14, the primary sear 28 is briefly depressed, which allows the firing device to be thrust forward by its spring 32, until the tip 24 of the firing pin hits the rear of the cartridge 12 to fire it. The recoil from the fired cartridge causes the bolt 20 to move rearwardly and compress a bolt spring 34. The rearwardly moving bolt moves the firing device 22 rearwardly, to a position at which the front of the extension rod 30 moves behind the primary sear 28, so the sear springs up again to lie in the path of the extension rod. The bolt removes a spent cartridge during rearward movement, and the bolt is then pushed forward by the spring 34, during which time the bolt chambers a new cartridge in the barrel.

The gun can be operated in a full automatic mode by depressing a control member 34 to push it in a direction towards the gun frame. Such depression of the member 34 causes a secondary sear 36 to be connected to the primary sear 28 so they pivot together about a sear axis 38. During semiautomatic operation, the secondary sear 36 is free to pivot about the axis 38 without moving the primary sear 28. Every time the bolt 20 moves forward, a cam 40 on the bolt rides across the secondary sear 36 and depresses it to pivot it down, although this causes no effect in the semiautomatic mode. However, when the member 34 is depressed to connect the two sears together for automatic operation, then every time the bolt moves forward and the cam 40 thereon depresses the secondary sear 36, the primary sear 28 is depressed to release the firing device 22 to fire the chambered cartridge. It is noted that at the time the cam 40 depresses the secondary sear 36, the primary sear 28 is already abutting the extension 30 of the firing device, so that a brief temporary depression of the primary sear 28 releases the firing device to fire the cartridge. It is also noted that the masses of the bolt and firing pin devices, and the forces exerted by their resepective springs, are chosen to assure that the bolt has moved to its full forward position before the firing pin catches up with it to fire a cartridge.

Figure 3:
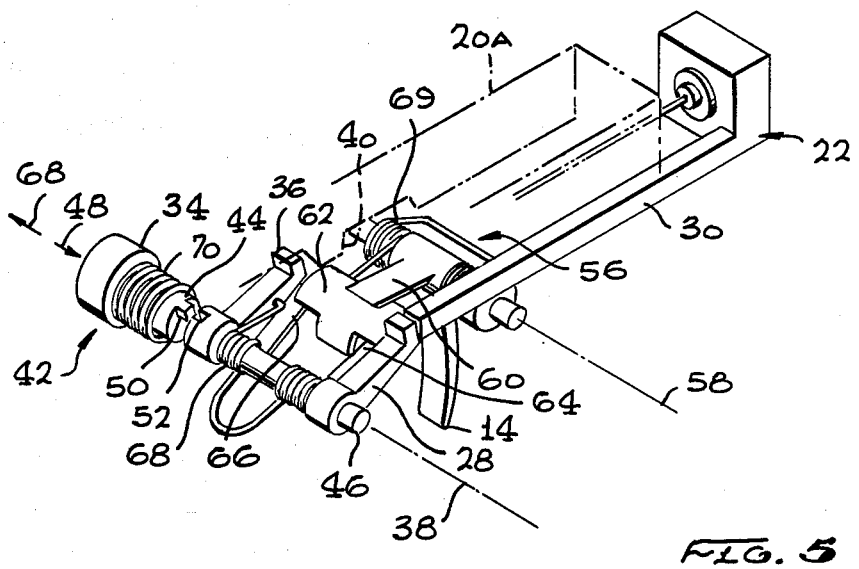
FIG. 3 is a partial perspective view of the firearm of FIG. 1, showing the trigger assembly and auto control thereof.
Figure 5:
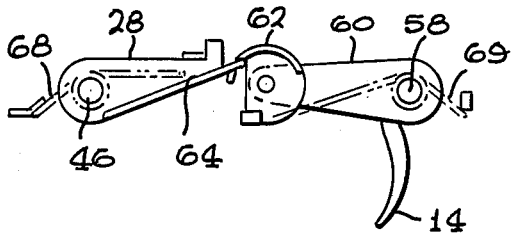
FIG. 5 is a partial side elevation view of the mechanism of FIG. 3.

FIG. 3 illustrates some of the details of operation of the auto control mechanism 42 which includes the control member 34. This auto mechanism 42 includes a connector 44 that is rotatably fixed to a sear shaft 46, but which can slide axially relative to the shaft, as by using a spline connection or sliding pin connection between them. The primary sear 28 is fixed to the shaft 46. When the control member 34 is pushed inwardly in the direction of arrow 48, a tooth 50 on the connector engages a tooth 52 on the secondary sear 36 (the tooth is one side of a recess), so the secondary sear 36 and the connector 44 are connected to pivot together, and therefore the two sears 36, 28 pivot together. When the bolt is at the position 20A, near its rearward position but moving forwardly, the primary sear 28 will have already engaged the firing device extension 30. The cam 40 on the bolt will then be approaching the secondary sear 36 and will depress it. If the control member 34 has been depressed so the connector 44 is connected to the secondary sear 36, then depresssion of the secondary sear 36 will cause depression of the primary sear 28 to release the firing device 22. Thus, the firing pin device will be released every time the bolt moves forward, so the gun will fire in a full automatic mode.

The trigger assembly 56 includes the trigger 14 which pivots about an axis 58 and which has a bar 60 extending forwardly. The trigger assembly also includes a sear horn 62 that engages ledges 64, 66 on the sears to depress them as the trigger is pulled and passes a middle position, and to then release the sears to extend up again as the trigger reaches a full rearward position. Although it is not necessary to depress the secondary sear, it is desirable to do so to move it out of the way of the bolt cam to minimize wear. A sear spring 68 urges both sears towards their extending positions, while a trigger spring 69 urges the horn up and the trigger forward.

As described above, when the auto control member 34 is depressed, the two sears 36, 28 pivot together and the gun operates in a full automatic mode. If the control member 34 is released, it will spring away from the frame in the direction of arrow 68 by a spring 70. Then, the connector 44 will no longer engage the secondary sear, and the gun will stop operating in the auto mode. Even if such release of the control member 34 occurs at a time when the trigger 14 remains pulled to its rearward position, the gun will stop firing. This is because with the control member released, subsequent depression of the secondary sear 36 by the bolt will not cause depression of the primary sear 28, and therefore the primary sear 28 will engage the extension 30 the next time the bolt has pushed back the firing pin device. This is of considerable importance, because during full automatic operation, there is a possibility that the machine gun will begin climbing out of control of the operator. The operator then may release the control member 34, but may forget to release the trigger 14. The fact that full automatic operation stops when the control member 34 is released, avoids continuing firing of the gun.

When the machine gun is used in the full automatic mode the secondary sear 36 is subjected to repeated blows from the cam 40 on the bolt. If the secondary sear 36 should break, the firearm is not totally disabled, but can still be fired in the semiautomatic mode, since such firing depends only upon operation of the primary sear 28.

Figure 2:
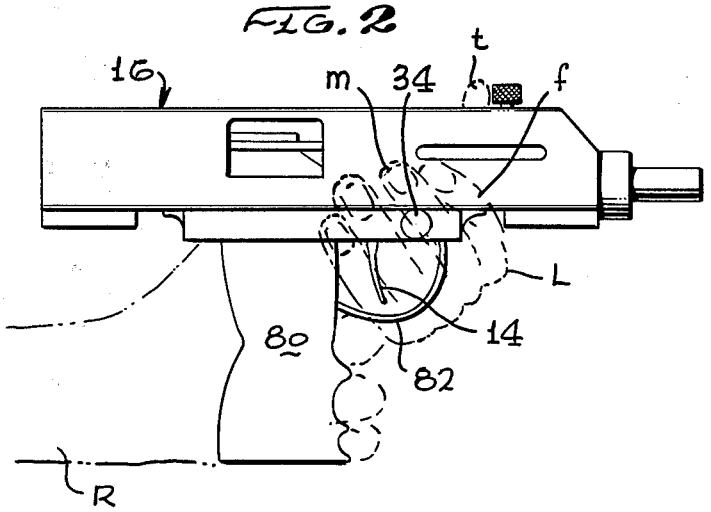
FIG. 2 is a right side elevation view of the firearm of FIG. 1, showing how it is held and operated.

The control member 34 is positioned and operated in a manner that facilitates secure handling of the firearm and good control of the auto mechanism. The firearm has a hand grip 80 (FIG. 2) lying behind the trigger 14, and the firearm can be operated by a righthanded person who grasps the hand grip 80 in his right hand R and with his forefinger on the trigger 14. For more secure holding of the gun, which is especially important in the full automatic mode, the operator also uses his left hand L to hold the firearm, by holding the gun frame 16 nested in his left hand between the thumb t and forefinger f of that hand. The left hand wraps about some of the fingers of the right hand, as well as a portion of the frame that lies immediately forward of the trigger guard 82. All of the fingers of the left hand except the thumb lie on the right side of the frame. In this position, the operator can easily feel the control member 34 as with his middle finger m, and can easily depress the control member when it is desired to switch to the full automatic mode, or release the member to switch back to the semiautomatic mode. Thus, by placing the control member 34 on the right side of the gun at a location forward of the trigger 14, the member can be easily sensed by the fingers of the left hand that also hold the gun, and the fingers can then easily depress and release the control member.

The use of a control 34 that switches to a full automatic mode and back to a semiautomatic mode, by respectively depressing and releasing the member, facilitates reliable operation of the device. Where, instead, a selector switch is used that must be moved forward and rearward, or up and down, there is a considerable likelihood of confusion on the part of the operator as to the current position of the member and the direction in which it must be moved. Where the member must be depressed for the full automatic mode and released for the semiautomatic mode, there is much less chance for confusion. It is easy for the operator to remember that if no pressure is applied to the control member 34, that it remains in the semiautomatic mode, and that a considerable depressing force such as ten pounds must be applied to switch to full automatic. The operator also knows whether or not the control member is in the full automatic mode, because he merely has to sense whether he is applying a full force or not. The ability to feel the control member 34 with his left hand, to know that switching to full automatic is accomplished by depressing the member, and to switch to the semiautomatic mode by releasing the member 34, all facilitate proper operation of the firearm under difficult conditions such as in the heat of battle.

Figure 6:
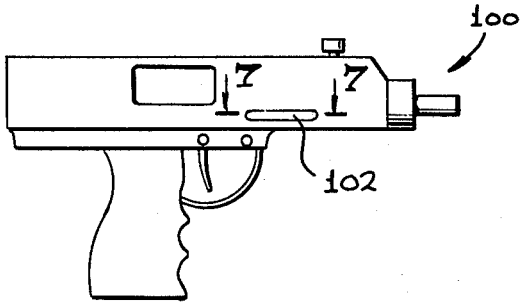
FIG. 6 is a right side elevation view of a firearm constructed in accordance with another embodiment of the invention.
Figure 7:
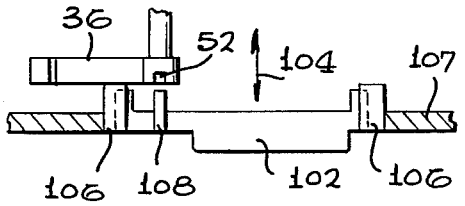
FIG. 7 is a view taken on the line 7—7 of FIG. 6.
Figure 4:
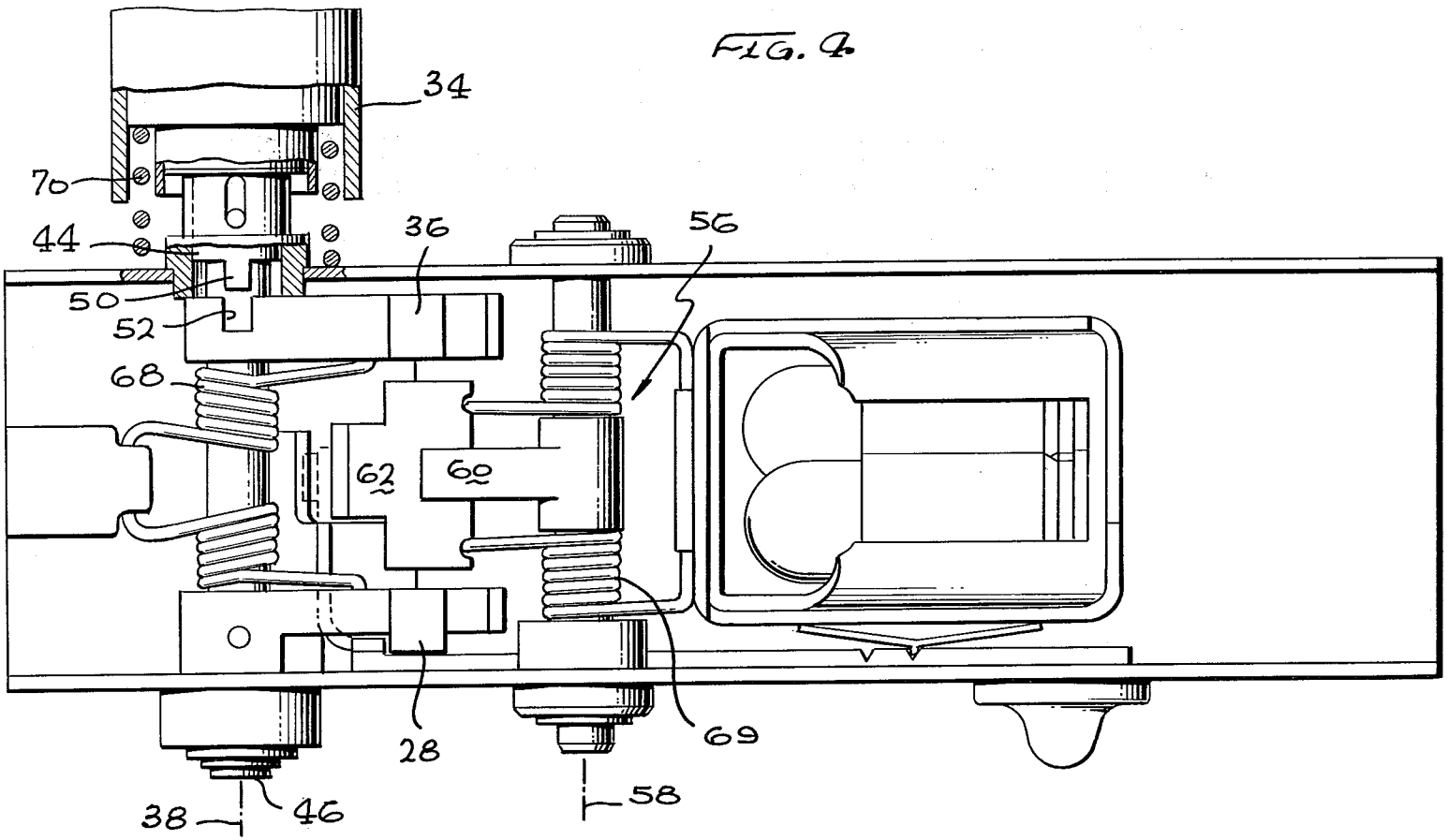
FIG. 4 is a more complete plan view of the mechanism of FIG. 3.

FIGS. 6 and 7 show another firearm 100 which is similar to that of FIG. 1, except that a control member 102 is used which is of elongated form with its length parallel to the length direction of the gun, to facilitate feeling and operation of the member by the operator of the weapon. The control member 102 is guided in sliding along the direction of arrows 104 by a pair of guides 106, so the member can be depressed into the frame 107 or released to move outwardly therefrom. A tooth 108 is mounted on the member to engage a corresponding tooth 52 on the secondary sear 36, so the mechanism operates in a manner similar to that of FIG. 3.

Thus, the invention provides a repeating firearm that facilitates operation and which is highly reliable. The firearm includes a manually operated control member for switching between full and semiautomatic operation, which is manually depressed towards the frame of the gun to switch to the full automatic operation. The control member is located on the right side of the gun frame forward of the trigger, at a position wherein a person holding the hand grip and trigger in the right hand and the gun portion immediately forward thereof in the left hand and with the gun craddled between the thumb and forefinger of the left hand, can feel the control member and easily depress it and release it. The gun includes a trigger assembly with a trigger that can be pulled rearwardly so at a middle location along the trigger path a primary sear is released to release the firing pin device, and with the sear returning to its extended position when the trigger is pulled to the full rearward position. A secondary sear which is depressed every time the bolt moves forward, can be coupled through a connector to the primary sear to retract them together, such coupling being accomplished when the auto control member is depressed.

Although particular embodiments of the invention have been described and illustrated herein, it is recognized that modifications and variations may readily occur to those skilled in the art and consequently, it is intended that the claims be interpreted to cover such modifications and equivalents.

We claim

1. A repeating firearm, comprising:

a gun frame with front and rear ends;

a gun barrel mounted on said frame;

a bolt moveable in predetermined longitudinal directions in said frame, including a forward longitudinal direction to chamber a cartridge at the rear of the barrel, and a rearward direction;

a firing pin device moveable forwardly in said frame to fire a chambered cartridge, and moveable rearwardly;

a trigger assembly mounted on said frame, including a trigger moveable by a person and a sear mechanism coupled to said trigger to control release of said firing pin device; and auto control means for controlling operation of said sear mechanism selectively in full automatic and semiautomatic modes;

said auto control means including a manually moveable auto control member which is accessible from outside said frame, a spring coupled to said member and urging said member toward a predetermined semiautomatic operating position while allowing it to be moved to a predetermined full automatic position, and coupling means for coupling said control member to said sear mechanism for repeatedly releasing said firing pin device for full automatic operation as long as the trigger is depressed when said control member is in said full automatic position, and for only singularly releasing said firing pin each time said trigger is depressed to operate in the semiautomatic mode when said control member is in said semiautomatic mode;

said auto control member being depressable to said full automatic position by the hand of a person operating the firearm and being extended by said spring to said semiautomatic position when not depressed, whereby the operator has to remember only to apply depressing forces to switch to the full automatic mode operation in the confusion of battle.

2. The firearm described in claim 1 wherein:

said trigger device includes a downwardly-extending trigger, and said frame includes a downwardly-extending pistol-type handgrip lying behind said trigger-for grasping by the right hand and a trigger guard lying about said trigger; and said depressible auto control member is located on the right side of the frame and forward of said handgrip at a position to be depressed by fingers of the left hand that lie opposite the thumb while the frame portion lying immediately forward of the trigger lies nestled between the thumb and forefinger of the left hand.

3. The firearm described in claim 1 wherein:

said sear mechanism includes a primary sear and a spring means for urging said sear to lie in the path of said firing pin device to prevent its forward movement, said trigger device being coupled to said primary sear to depress it out of said path to release the firing device when the trigger device is operated;

said auto control means includes a secondary sear moveable between depressed and extended positions, and spring means urging said secondary sear toward said extended position, and said auto control means connects said primary and secondary sears when said secondary sear is depressed at a time when said auto control member is depressed;

said bolt having a cam positioned to depress the secondary sear as the bolt moves forward.

4. In a repeating firearm which includes a gun frame with left and right sides, a slideable bolt, an independently slideable firing pin device, and a trigger device that can release the firing pin device, the improvement of an auto control comprising:

a control member lying outside the gun frame; and means for coupling said control member to said trigger assembly to operate said trigger assembly alternately in full and semi automatic modes when said member is in first and second positions;

said member being depressable toward said gun frame to move to said first position, and releasable to move away from the frame to said second position, and said coupling means includes a spring urging said member away from the direction of depression;

said member lying on the right side of said gun frame forward of said trigger, for depression by the fingers of a left hand, when the left hand holds the portion of the gun which lies forward of the trigger so the gun is nestled between the thumb and forefinger of the left hand.

5. A firearm which can fire in either a semiautomatic or full automatic mode, and which can be released from the full automatic mode while the trigger is depressed, comprising:

a frame;

a barrel;

a bolt slideable in forward and rearward directions within said frame and having chambering means for chambering a cartridge in said barrel;

a firing pin device slideable parallel to said bolt and having a firing pin for firing a chambered cartridge;

a trigger assembly which includes a trigger that can be pulled rearwardly, from a forward position past a middle position to a rearward position, a primary sear, spring means for urging said sear toward an extended position in the path of said firing pin assembly, and means for coupling said trigger to said sear for depressing said sear out of the path of said firing pin assembly when the trigger is moved to said middle position and for releasing said sear to return to said extended position when said trigger is pulled to said rearward position;

an auto control which includes a secondary sear moveable between extended and depressed positions, and a control which is moveable between a full auto position, at which the control connects said primary and secondary sears so that when said secondary sear is depressed it also moves said primary sear to a depressed position, and a semi auto position at which the control does not connect said sears;

said bolt having a cam which moves said secondary sear to said depressed position thereof as the bolt moves forward.

6. The firearm described in claim 5 wherein:

said trigger assembly includes a sear shaft that is pivotably mounted on said frame, said primary sear being fixed in rotation with respect to said sear shaft;

said secondary sear is pivotally mounted on said sear shaft; and said control includes a connector fixed in rotation to said sear shaft but moveable along the shaft axis, said connector having an engager which engages said secondary sear to prevent their relative rotation when said control is shifted in a predetermined inward direction, said control also including a spring urging said connector in a direction opposite to said inward direction whereby the secondary sear does not depress the primary sear until the connector is moved inwardly.

7. The firearm described in claim 6 wherein:

said control includes a manually depressable member mounted on said connector and projecting from a side of said frame, said member moving in said inward direction when depressed toward said frame.

8. The firearm described in claim 5 wherein:

said control projects from said frame and is depressable toward the frame in moving from said semi auto position to said full auto position, said control projecting from a location on the left side of the frame which can be depressed by the ring finger of the left hand of a person that holds the frame cradled between the thumb and forefinger of his left hand at a location forward of the trigger.

9. In a repeating firearm which includes a bolt and firing pin device that can independently slide forward and rearward within a gun frame that holds a barrel, and which also includes a trigger that can depress a primary sear to release the firing device held by the primary sear, the improvement of an auto control for enabling full automatic operation comprising:

a cam mounted on said bolt to move with it;

a depressable secondary sear with a portion in the path of said cam, so the cam depresses the secondary sear as the bolt moves forward; and a manually moveable connector that can move to an auto position at which it connects said secondary sear to said primary sear, so that at every forward movement of the bolt and cam the primary sear is depressed to release the firing device for full automatic operation, and that can move to a semi position at which the connector does not connect said sears, so the firing device is released only every time the trigger is pulled.

10. The improvement described in claim 9 wherein:

said auto control includes a member located at a side of said frame and moveable toward and away from the gun frame, and a spring urging the member away from said frame, said member coupled to said connector to move said connector to said auto position when said member is depressed toward said frame and to move said connector to said semi position when said member is not depressed so said spring keeps it away from the frame.

* * * * *